US008248336B2

(12) United States Patent
Hwang et al.

(10) Patent No.: US 8,248,336 B2
(45) Date of Patent: Aug. 21, 2012

(54) LIQUID CRYSTAL DISPLAY DEVICE AND OPERATING METHOD THEREOF

(75) Inventors: Hanwook Hwang, Gyeongsangbuk-do (KR); Sangho Kim, Chungcheongnam-do (KR)

(73) Assignee: LG Display Co., Ltd., Seoul (KR)

( * ) Notice: Subject to any disclaimer, the term of this patent is extended or adjusted under 35 U.S.C. 154(b) by 1198 days.

(21) Appl. No.: 11/295,514

(22) Filed: Dec. 7, 2005

(65) Prior Publication Data

US 2006/0208985 A1 Sep. 21, 2006

(30) Foreign Application Priority Data

Dec. 7, 2004 (KR) ..... 10-2004-0102593

(51) Int. Cl.
*G09G 3/36* (2006.01)

(52) U.S. Cl. ..... 345/87; 345/92; 345/55; 345/204

(58) Field of Classification Search ..... 345/87, 345/92, 55, 204
See application file for complete search history.

(56) References Cited

U.S. PATENT DOCUMENTS 7,277,074 B2 * 10/2007 Shih ..... 345/87
2002/0154084 A1 * 10/2002 Tanaka et al. ..... 345/92

FOREIGN PATENT DOCUMENTS

JP 11-282431 * 10/1999

* cited by examiner

*Primary Examiner* — William Boddie
*Assistant Examiner* — Leonid Shapiro
(74) *Attorney, Agent, or Firm* — Morgan, Lewis & Bockius, LLP

(57) ABSTRACT

A liquid crystal display device includes one or more data line on a substrate; first and second gate lines crossing the one or more data line to form first and second pixels, the one or more data line providing an image signal to a first electrode of each of the first and second pixels, and the first and second gate lines providing first and second scan signals to the first and second pixels, respectively; a first common voltage unit corresponding to the first gate line, the first common voltage unit for selectively applying a first common voltage to a second electrode of the first pixel via a first common voltage line in accordance with one of the first and second scan signals; and a second common voltage unit corresponding to the second gate line, the second common voltage unit for selectively applying a second common voltage to a second electrode of the second pixel via a second common voltage line in accordance with another one of the first and second scan signals.

10 Claims, 8 Drawing Sheets

LIQUID CRYSTAL DISPLAY DEVICE AND OPERATING METHOD THEREOF

This application claims the benefit of Korean Patent Application No. P2004-102593 filed in Korea on Dec. 7, 2004, which is hereby incorporated by reference in its entirety.

BACKGROUND OF THE INVENTION

1. Field of the Invention

The present invention relates to a liquid crystal display device, and more particularly, to a driving circuit for a liquid crystal display device.

2. Description of the Related Art

In general, a liquid crystal display (LCD) device is formed by attaching a thin film transistor (TFT) array substrate and a color filter (CF) substrate together to face each other with a specified cell gap therebetween, and filling the cell gap with a liquid crystal material. A plurality of gate lines are arranged at regular intervals along a horizontal direction and a plurality of data lines are arranged at regular intervals along a vertical direction on the TFT array substrate to cross each other. Crossings of the data lines with the gate lines define pixel regions. Each pixel region includes a switching device and a pixel electrode. In addition, red, green and blue color filters corresponding to the pixel regions are formed on the CF substrate. A black matrix is formed in a mesh shape that encompasses an outer edge of the color filters. The black matrix prevents color interference of light passing through the pixel regions. Furthermore, a common electrode is formed on the CF substrate. The common electrode and the pixel electrode generate an electric field through the liquid crystal material.

Twisted nematic (TN) liquid crystal material is commonly used in LCD devices. In a TN liquid crystal display device, a vertical electric field drives the liquid crystal material. The vertical electric field is generated between the pixel electrode formed on the thin film transistor array substrate and the common electrode formed on the color filter substrate. Accordingly, light transmittance of the TN liquid crystal material changes according to a viewing angle of an observer. Especially, the light transmission is asymmetrically distributed with respect to a vertical viewing angle, generating a range in which an image is reversed vertically and causing a narrow viewing angle. As a result, the fabrication of a large area liquid crystal display panel is difficult.

In order to solve the above problem, an in-plane-switching (IPS) mode liquid-crystal display device has been suggested for driving the liquid crystal material with a horizontal electric field. The IPS LCD device may improve angular field characteristics, such as contrast, gray inversion, and color shift, thus providing a wide angular viewing field, in comparison to the LCD device in which the liquid crystal material is driven by a vertical electric field. Hence, the IPS LCD device is commonly used in large-size LCD devices.

FIG. 1A is a planar view illustrating a pixel of a related art in-plane switching mode liquid crystal display device. FIG. 1B is a cross sectional view of the in-plane switching mode liquid crystal device of FIG. 1A. Referring to FIGS. 1A and 1B, gate lines 1 and data lines 3 form a matrix on a first substrate 10, thus defining a pixel region. A thin film transistor 9 consisting of a gate electrode 1*a*, a semiconductor layer 5 and source/drain electrodes 2*a* and 2*b* is formed at a crossing of one of the gate lines 1 and one of the data lines 3. The gate electrode 1*a* is electrically connected to the gate line 1, and the source/drain electrodes 2*a* and 2*b* are electrically connected to the data line 3.

A common voltage line 4 is arranged parallel to the gate line 1 in the pixel region. At least one pair of a common electrode 6 and a pixel electrode 7 is arranged parallel to the data line 3 for applying an electric field to liquid crystal molecules. The common electrode 6 is formed simultaneously with the gate line 1 and connected to the common voltage line 4. The pixel electrode 7 is formed simultaneously with the source/drain electrodes 2*a* and 2*b* and connected to the drain electrode 2*b* of the thin film transistor 9. A passivation film 11 is formed on the entire surface of the substrate 10 including the source/drain electrodes 2*a* and 2*b*. A pixel electrode line 14 is formed to overlap the common line 4 and is connected to the pixel electrode 7, thus forming storage capacitors Cst.

A black matrix 21 for preventing light leakage to the thin film transistor 9, the gate line 1, the data line 3, and a color filter 23 for displaying a color image are formed on a second substrate 20. An overcoat film (not shown) for flattening the color filter 23 is formed thereon. Alignment films 12*a* and 12*b* are formed at facing surfaces of the first and second substrates 10 and 20. The alignment films 12*a* and 12*b* determine an initial alignment direction of liquid crystals.

A liquid crystal layer 13 is provided between the first and second substrates 10 and 20. The light transmittance of the liquid crystal layer 13 is controlled by a voltage applied between the common electrode 6 and the pixel electrode 7. The related art in-plane switching mode LCD device having the above-described structure can improve the viewing angle because the common electrodes 6 and the pixel electrodes 7 are disposed on the same plane and thus generate an in-plane electric field.

FIG. 2 is a schematic view of the pixel regions in the liquid crystal display device of FIG. 1. Referring to FIG. 2, the liquid crystal display device includes a plurality of data lines DL1 to DLm arranged at regular intervals in a vertical direction, a plurality of gate lines GL1 to GLn arranged at regular intervals in a horizontal direction, a plurality of pixels P1 formed by crossings of the data lines DL1 to DLm and the gate lines GL1 to GLn, and a plurality of common voltage lines VL1 corresponding to the gate lines GL1 to GLn and supplying a common voltage to the pixels P1.

The pixels P1 are electrically connected to the gate lines GL1 to GLn and the data lines DL1 to DLm. More specifically, the gate electrode of the thin film transistor T1 provided within each of the pixels P1 is connected to one of the gate lines GL1 to GLn, and the source electrode thereof is connected to one of the data lines DL1 to DLm. A liquid crystal capacitor Clc and a storage capacitor Cst are electrically connected in parallel between the drain electrode of the thin film transistor T1 and the common voltage line VL1. The common voltage line VL1 is commonly connected to each of the pixels P1, thereby supplying the same common voltage VCOM to each pixel P1.

The gate lines GL1 to GLn are sequentially activated by applying a scan signal from a gate driving unit (not shown). The scan signal is applied to the gate electrodes of a plurality of thin film transistors T1 connected to the corresponding gate lines GL1 to GLn, thereby turning on the thin film transistors T1. As stated above, the source electrodes of the thin film transistors T1 are connected to the data lines DL1 to DLm, and thus an image voltage applied to the data lines DL1 to DLm is provided to the source electrodes of the turned-on thin film transistors T1.

When an electric field is continuously supplied to the liquid crystal material, the liquid crystal material deteriorates, thereby causing afterimage distortions due to a DC voltage component. To eliminate the DC voltage component, and prevent deterioration of the liquid crystal material, a positive (+) voltage and a negative (−) voltage corresponding to the image information are alternately supplied as the common voltage. Such a driving method is commonly called an inversion driving method.

Several types of inversion driving methods have been proposed. In a frame inversion driving method, a polarity of the supplied image information is inverted for each frame period. In a line inversion driving method, the polarity of the supplied image information is inverted for each gate line. In a dot inversion driving method, the polarity of the supplied image information is inverted from one pixel to the adjacent one, and also inverted for each frame period.

FIG. 3A illustrates typical voltage waveforms corresponding to an image voltage and a common voltage in accordance with the line inversion method. FIG. 3B illustrates typical voltage waveforms of an image voltage and a common voltage in accordance with the dot inversion method. Referring to FIGS. 3A and 3B, a voltage difference between the supplied image voltage Vdata and the common voltage VCOM is set to 5V.

Referring to FIG. 3A, the common voltage VCOM applied through a common voltage line to each pixel P1 is shifted from a high voltage (5V) to a low voltage (0V) or from a low voltage (0V) to a high voltage (5V) at each horizontal period. The supplied image voltage Vdata is applied to a pixel at each horizontal period with a polarity opposite to that of the common voltage VCOM. Thus, even if the swing of the image voltage Vdata is reduced to a range between 0V to 5V, the voltage difference ΔV1 between the common voltage VCOM and the image voltage Vdata can be increased.

Referring to FIG. 3B, the common voltage VCOM applied to the common voltage line is a direct current voltage having the same level in each horizontal period. Thus, if the voltage level of the common voltage VCOM is fixed, the voltage difference ΔV2 between the common voltage VCOM and the image voltage Vdata can only be controlled by adjusting the image voltage Vdata. Thus, to set the voltage difference ΔV2 to a value of 5V as in the line inversion method, the image voltage Vdata has to be swung from 0V to 10V, which increases power consumption compared to the line inversion method. Hence, the line inversion method can reduce the power required for switching the image voltage Vdata compared to the dot inversion method. However, in the line inversion method, the common voltage VCOM has to be driven along with the image voltage Vdata. Especially, in the in-plane switching mode liquid crystal display device, a common voltage VCOM larger than that required by the related art TN liquid crystal display device has to be applied to drive the common voltage VCOM at a direct current.

In the twisted nematic liquid crystal display device, the common voltage applied to the dots of TFT array substrate drives a relatively low load because the common electrode is formed over the entire surface of a color filter substrate. In contrast, in the in-plane switching mode liquid crystal display device, both the common electrode and the pixel electrode are provided together within the pixel region. For example, the common electrode is usually formed in a long, narrow bar shape within the pixel region to increase the aperture ratio of the pixel. Thus, the common electrode in the IPS mode LCD can have a relatively high resistance. Accordingly, the common voltage applied from the driving circuit drives a large load. Hence, the common voltage waveforms applied to each pixel are delayed or distorted by the relatively large load.

FIG. 4 shows a typical common voltage waveform applied to pixels in a related art in-plane switching mode liquid crystal display device. Referring to FIG. 4, a dotted line represents a ideal waveform for a common voltage VCOM, and a solid line represents an actual waveform for the common voltage VCOM applied to the pixels of a related art IPS mode LCD. As can be inferred from FIG. 4, in the in-plane switching mode liquid crystal display device, the resistance of the common electrode provided in each pixel region is high, and the overall resistance of liquid crystal display is high, thus causing a time delay before the applied common voltage VCOM reaches a desired voltage level. The time delay before the common voltage VCOM can reach a desired voltage level causes the corresponding waveform to have a slowly rising curve shape rather than a square shape. Also, the common voltage VCOM might fall without ever reaching the desired level within the horizontal period.

When the common voltage VCOM cannot reach a desired voltage level, the image voltage has to be increased to form a desired voltage difference between the common electrode and the pixel electrode, thus increasing the required driving power. Further, when the common voltage VCOM cannot reach the desired level, the pixels are not charged with a sufficient voltage, thereby deteriorating the quality of the displayed image.

As discussed above, when the load provided by each of the pixels of the in-plane switching mode liquid crystal display device increases, in spite of using the line inversion method for reducing power, the benefits provided by the method are hampered, making it difficult to charge the pixels with sufficient electric charges, and, thereby, deteriorating the quality of the displayed image.

SUMMARY OF THE INVENTION

Accordingly, the present invention is directed to a liquid crystal display device that substantially obviates one or more of the problems due to limitations and disadvantages of the related art.

An object of the present invention is to provide a liquid crystal display device that improves the quality of a displayed image.

To achieve these and other advantages and in accordance with the purpose of the present invention, as embodied and broadly described, a liquid crystal display device includes one or more data line on a substrate; first and second gate lines crossing the one or more data line to form first and second pixels, the one or more data line providing an image signal to a first electrode of each of the first and second pixels, and the first and second gate lines providing first and second scan signals to the first and second pixels, respectively; a first common voltage unit corresponding to the first gate line, the first common voltage unit for selectively applying a first common voltage to a second electrode of the first pixel via a first common voltage line in accordance with one of the first and second scan signals; and a second common voltage unit corresponding to the second gate line, the second common voltage unit for selectively applying a second common voltage to a second electrode of the second pixel via a second common voltage line in accordance with another one of the first and second scan signals.

In another aspect, a liquid crystal display device includes a plurality of pixels arranged on a substrate; a plurality of data lines and gate lines arranged on the substrate to form a matrix; a first electrode and a second electrode provided on the respective pixels; a plurality of common voltage units corresponding to the gate lines and selectively outputting a first common voltage or a second common voltage according to a scan signal applied via the gate lines; and common electrodes and pixel electrodes respectively provided at the pixels for forming a horizontal electric field within the pixel, the common electrodes receiving a first common voltage or a second common voltage applied from the common voltage units, and the pixel electrodes receiving an image voltage applied via the data lines.

In another aspect, a liquid crystal display device, which displays an image by driving a liquid crystal material by a difference between a common voltage and an image voltage, includes a substrate; a plurality of rows of pixels arranged on the substrate; a gate driving unit sequentially applying a scan signal to each of the rows of pixels; a data driving unit applying an image voltage to the pixels in each row selected by the scan signal; and a plurality of common voltage units provided at each row of pixels, each common voltage unit being driven by the scan signals applied to a previous row of pixels to charge a common voltage into a current row of pixels.

In another aspect, a method of driving a liquid crystal display device includes providing an image signal to a first electrode of each of first and second pixels through one or more data line; providing first and second scan signals to the first and second pixels respectively through first and second gate lines; selectively applying a first common voltage outputted by a first common voltage unit corresponding to the first gate line to a second electrode of the first pixel via a first common voltage line in accordance with one of the first and second scan signals; and selectively applying a second common voltage outputted by a second common voltage unit corresponding to the second gate line to a second electrode of the second pixel via a second common voltage line in accordance with another one of the first and second scan signals.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1A:
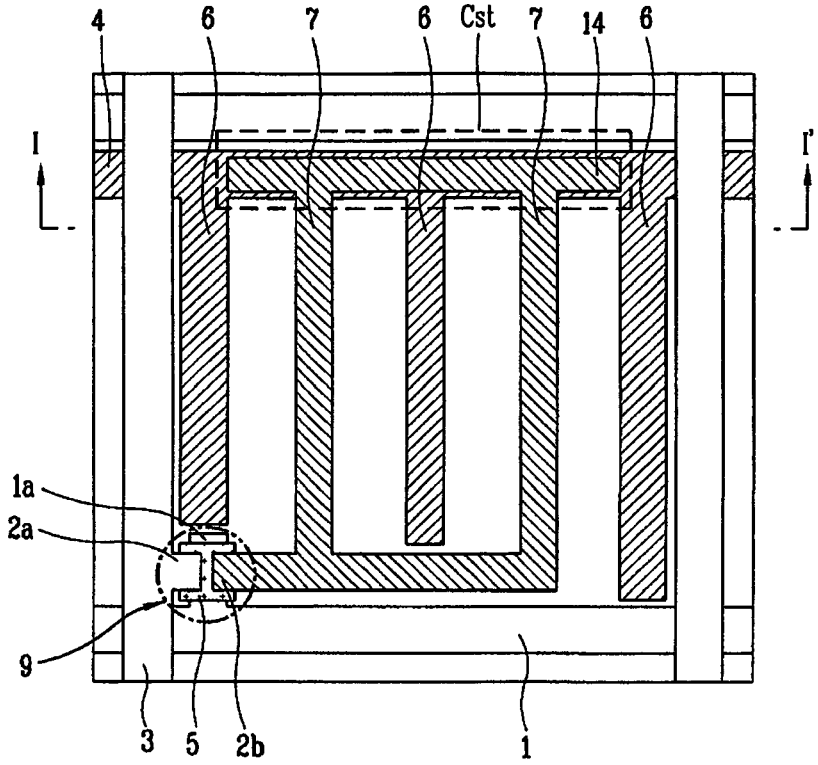
FIG. 1A RELATED ART
FIG 1A is a planar view illustrating a pixel of a related art in-plane switching mode liquid crystal display device.
Figure 1B:
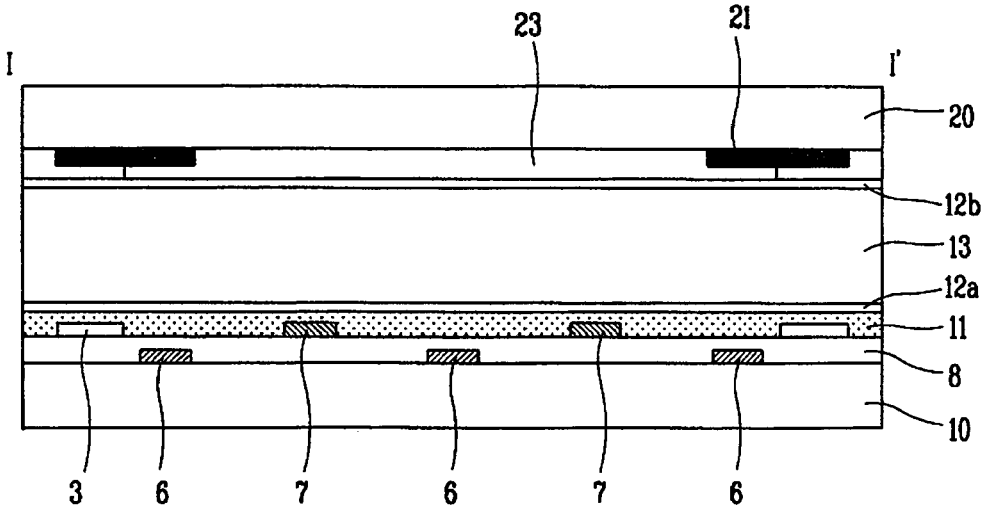
FIG. 1B RELATED ART
FIG. 1B is a cross sectional view of the in-plane switching mode liquid crystal device of FIG 1A.
Figure 2:
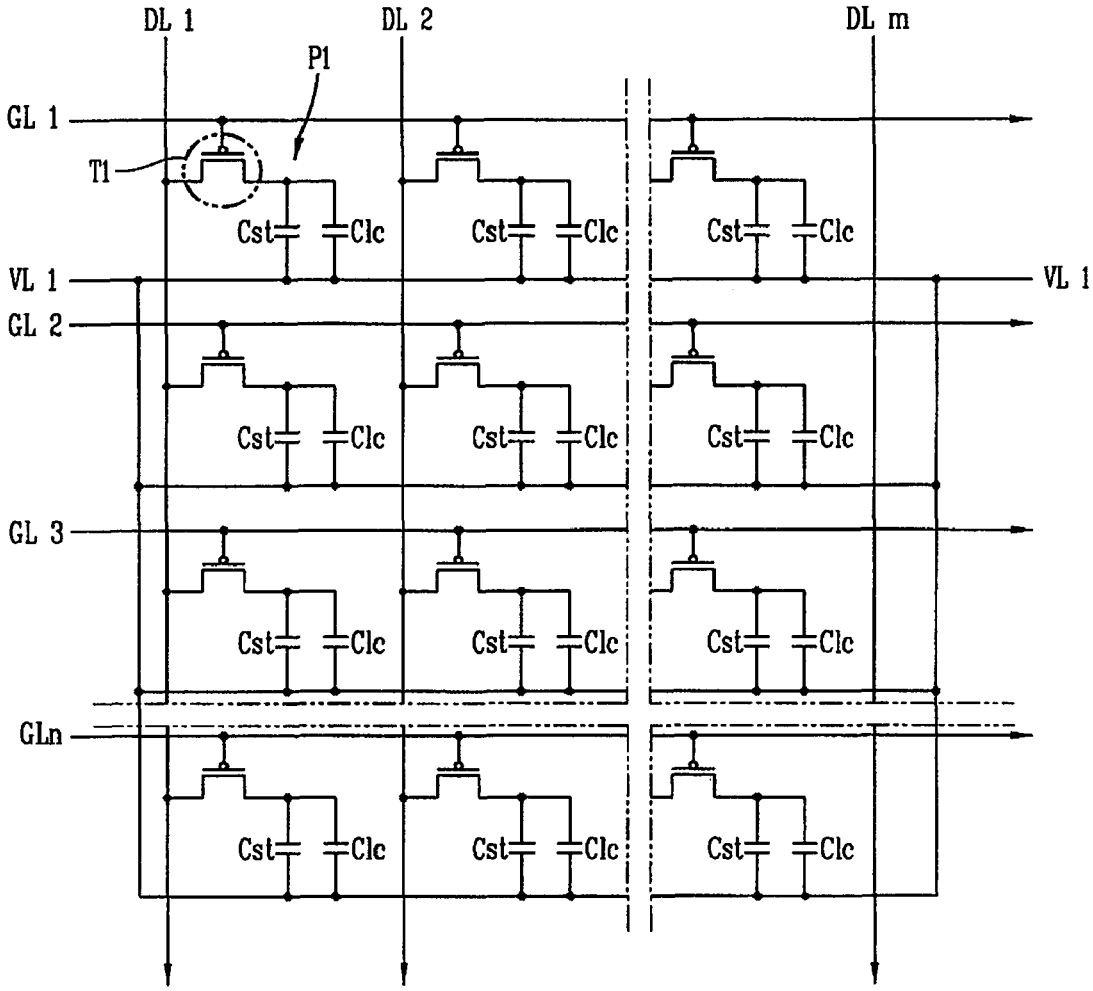
FIG. 2 RELATED ART
FIG. 2 is a schematic view of the pixel regions in the liquid crystal display device of FIG. 1.
Figure 3A:
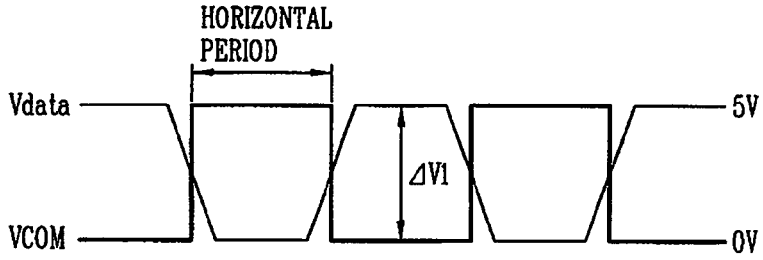
FIG. 3A RELATED ART
FIG. 3A illustrates typical voltage waveforms corresponding to an image voltage and a common voltage in accordance with the line inversion method.
Figure 3B:
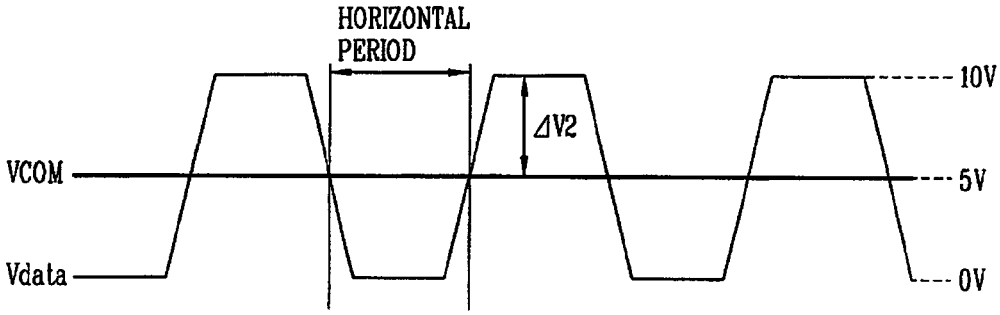
FIG. 3B RELATED ART
FIG. 3B illustrates typical voltage waveforms corresponding to an image voltage and a common voltage in accordance with the dot inversion method.
Figure 4:
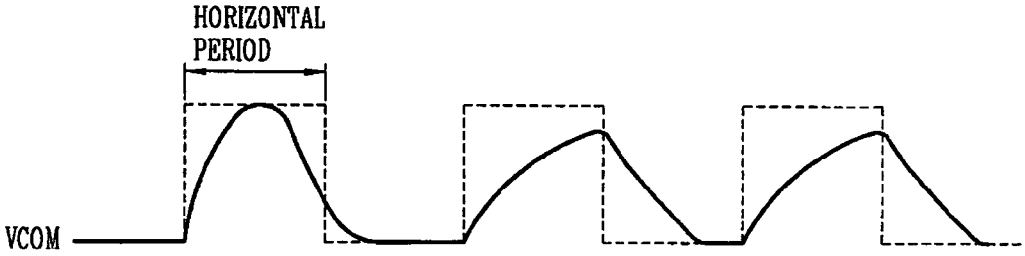
FIG. 4 RELATED ART
FIG. 4 shows a typical common voltage waveform applied to pixels in a related art in-plane switching mode liquid crystal display device.
Figure 5:
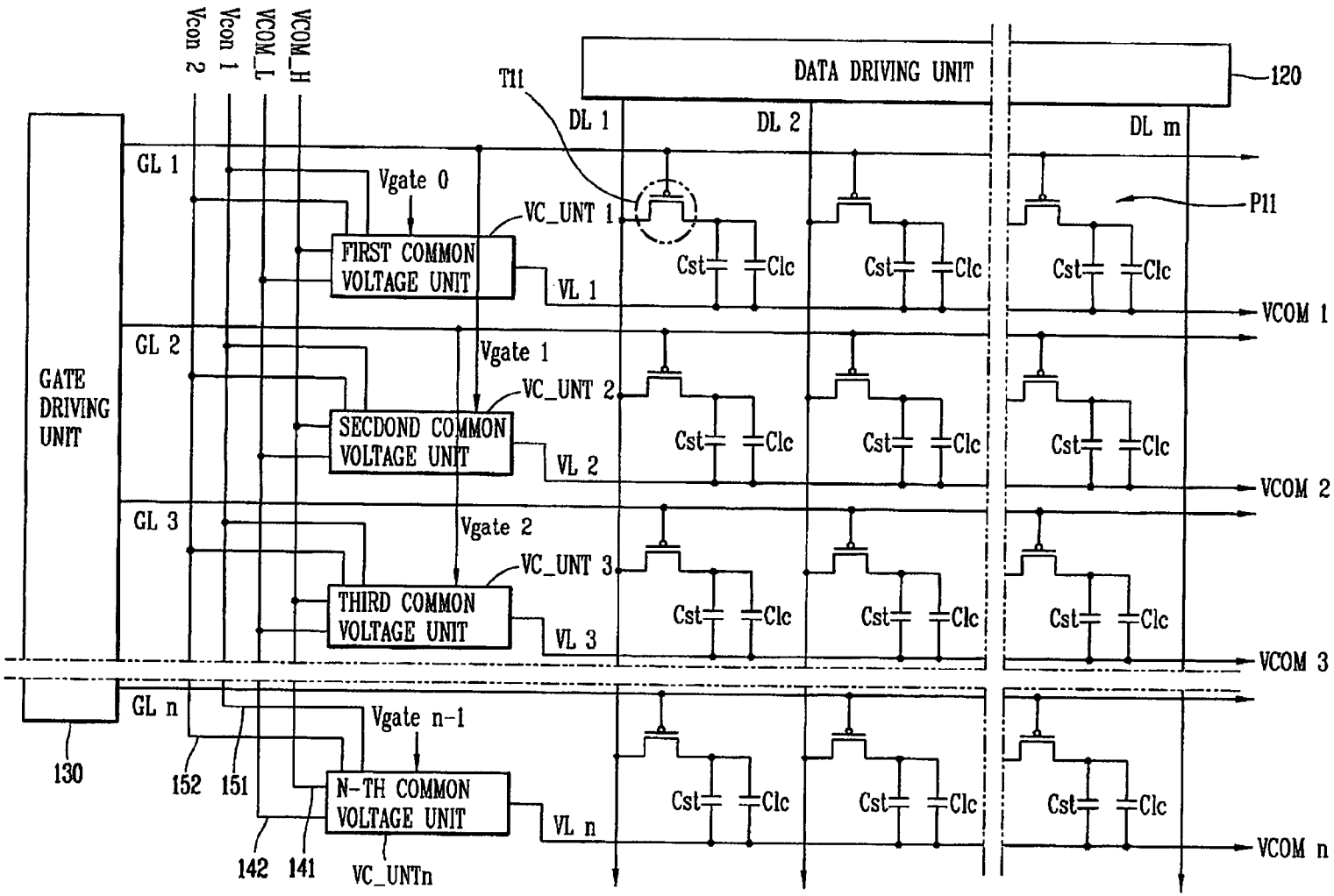
FIG. 5 is a schematic view of an exemplary driving circuit for a liquid crystal display device in accordance with an embodiment of the present invention.

FIG. 5 is a schematic view of an exemplary driving circuit for a liquid crystal display device in accordance with a first embodiment of the present invention. Referring to FIG. 5, the liquid crystal display device includes a plurality of data lines DL1 to DLm and a plurality of gate lines GL1 to GLn arranged in a matrix on a substrate (not shown) and crossing each other. Crossings of the data lines DL1 to DLm and the gate lines GL1 to GLn define a plurality of pixels P11. A data driving unit 120 is provided for supplying an image voltage to each of the pixels P11 via the data lines DL1 to DLm. A gate driving unit 130 is provided for supplying a scan signal to one or more of the gate lines GL1 to GLn. A plurality of common voltage lines VL1 to VLn is formed on the substrate in a transverse direction to correspond to the gate lines GL1 to GLn. The common voltage lines VL1 to VLn are electrically connected to the pixels P11.

A thin film transistor (TFT) T11 is provided at each of the pixels P11. A gate electrode of the TFT T11 is connected to one of the gate lines GL1 to GLn. A source electrode of the TFT T11 is connected to one of the data lines DL1 to DLm. A liquid crystal capacitor Clc and a storage capacitor Cst are electrically connected in parallel between a drain electrode of the TFT T11 and one of the common voltage lines VL1 to VLn.

The storage capacitor Cst is electrically charged depending on a voltage difference between an image voltage applied to a pixel electrode via one of the data lines DL1 to DLm and a common voltage applied to a common electrode via one of the common voltage lines VL1 to VLn. Therefore, the storage capacitor Cst maintains a driving voltage at the pixel P11 during one frame period.

A plurality of common voltage units VC-UNT1 to VC_UNTn is formed to correspond to the gate lines GL1 to GLn. Each of the common voltage units VC-UNT1 to VC_UNTn outputs a common high voltage or a common low voltage to a corresponding one of the common voltage lines VL1 to VLn in synchronization with the scan signal. A common high voltage line 141, a common low voltage line 142, a first control signal line 151 and a second control signal line 152 are connected to the common voltage units VC_UNT1 to VC_UNTn. The common voltage units VC_UNT1 to VC_UNTn can be made of low temperature polysilicon (LTPS), for example.

A first control signal line 151 and a second control signal line 152 electrically connect each of the common voltage units VC_UNT1 to VC_UNTn to a timing controller (not shown). Therefore, each of the common voltage units VC_UNT1 to VC_UNTn is provided with a first and a second control signals Vcon1 and Vcon2. A common high voltage VCOM_H and a common low voltage VCOM_L are provided as a high common reference voltage and a low common reference voltage, respectively, for each of the common voltage units VC_UNT1 to VC_UNTn.

The gate driving unit 130 sequentially outputs a scan signal to each of the gate lines GL1 to GLn. The thin film transistors T11 connected to the corresponding one of the gate lines GL1 to GLn are turned on by the outputted scan signal. Thus, an image voltage is applied to each of the pixels P11.

The scan signal sequentially outputted from the gate driving unit 130 is supplied to one of the gate lines GL1 to GLn corresponding to a current driving stage, and simultaneously supplied to one of the common voltage units VC_UNT2 to VC_UNTn corresponding to a following one of the gate lines GL2 to GLn of a next driving stage. For instance, a scan signal Vgate1 outputted via the first gate line GL1 is supplied to the second common voltage unit VC_UNT2 corresponding to the second gate line GL2. Similarly, a scan signal Vgate2 outputted to the second gate line GL2 is also supplied to the third common voltage unit VC_UNT3, and so on.

Thus, the one of the common voltage units VC_UNT1 to VC_UNTn of the next stage is driven in advance by the scan signal of the current stage to output a common voltage to the corresponding one of the common voltage lines VL1 to VLn. Accordingly, the common voltage applied to the common electrode of the corresponding pixels P11 of the next stage is pre-increased to a desired level. Hence, while an image voltage is being applied to a current row of pixels P11, a common voltage is pre-applied to a next row of pixels. Then, each of the common voltage units VC_UNT1 to VC_UNTn selectively outputs a common low voltage VCOM_L or a common high voltage VCOM_H depending on the first control signal Vcon1 or the second control signal Vcon2 inputted thereto.

An n-th common voltage unit VC_UNTn and a following (n+1)-th common voltage unit VC_UTNn+1 alternately output a common low voltage VCOM_L and a common high voltage VCOM_H, respectively. For example, when the first common voltage unit VC_UNT1 outputs a common low voltage VCOM_L, the second common voltage unit VC_UNT2 outputs a common high voltage VCOM_H, the third common voltage unit VC_UNT3 outputs a common low voltage VCOM_L, and so on. Each of the common voltage units VC_UNT1 to VC_UNTn outputs a common voltage that switches between a common low voltage VCOM_L or a common high voltage VCOM_H at each frame period. Thus, the liquid crystal display device is driven by a line inversion method.

As described above, the common voltage units VC_UNT1 to VC_UNTn are provided on the respective common voltage lines VL1 to VLn. Thus, in an embodiment of the present invention, each of the common voltage units VC_UNT1 to VC_UNTn drives only one of the common voltage lines VL1 to VLn. Therefore, the load powered by the common voltage is reduced.

Figure 6A:
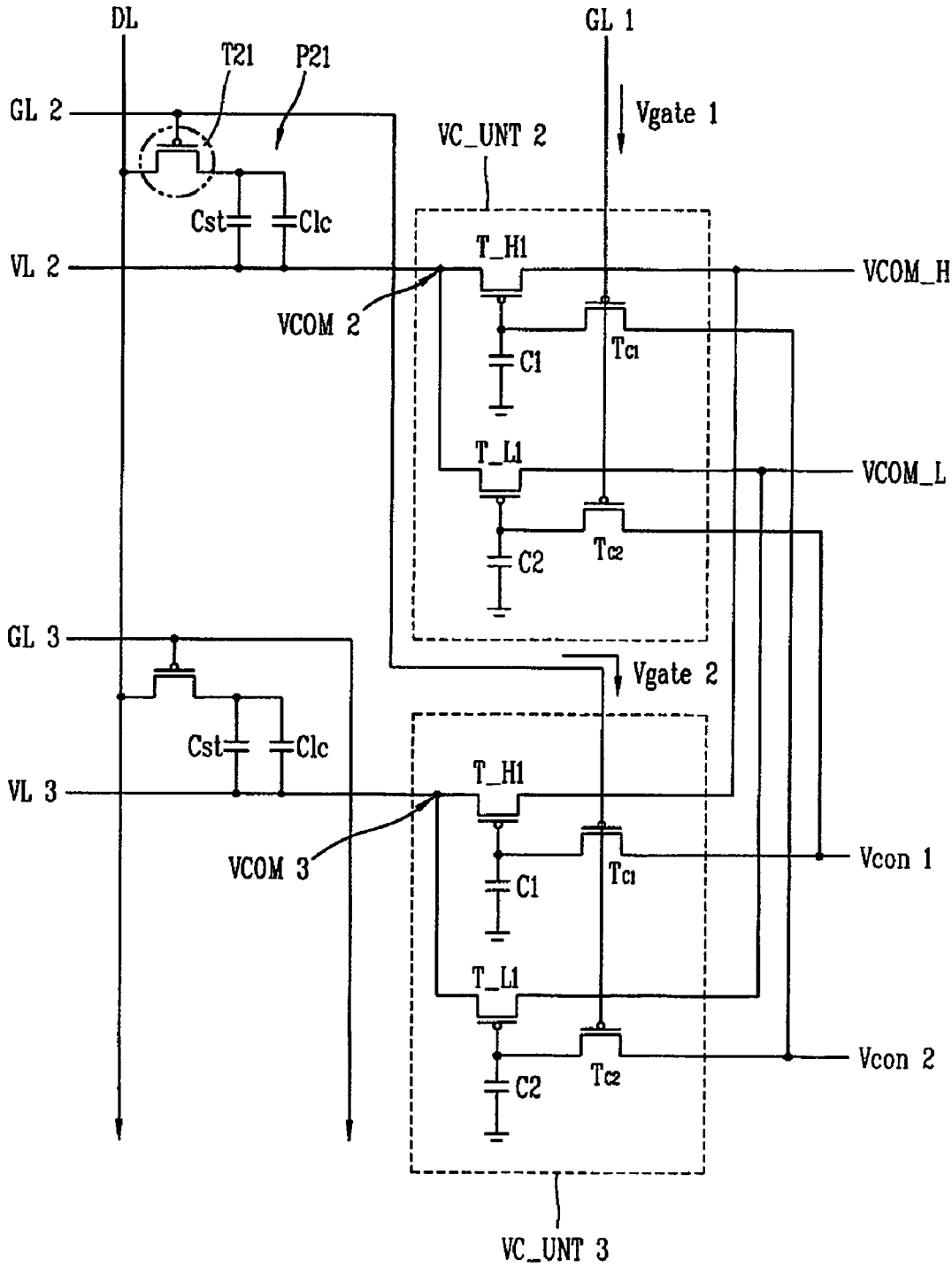
FIG. 6A is a detailed schematic view of exemplary common voltage units for the liquid crystal display device of FIG. 5.

FIG. 6A is a detailed schematic view of exemplary common voltage units for the liquid crystal display device of FIG. 5. Referring to FIG. 6A, each of the common voltage units VC_UNT2 and VC_UNT3 corresponding to driving stages 2 and 3, respectively, includes first and second transistors Tc1 and Tc2, and third and fourth transistors T_H1 and T_L1. The first and second transistors Tc1 and Tc2 in the common voltage unit VC_UNT2 are controlled by a scan signal Vgate1 provided on the gate line GL1 of a previous driving stage 1 (not shown). Similarly, the first and second transistors Tc1 and Tc2 in the common voltage unit VC_UNT3 are controlled by a scan signal Vgate2 provided on the gate line GL2 of the previous driving stage 2. Depending on the Vgate1 and Vgate2 scan signals, one of the first and second transistors Tc1 and Tc2 transfers or blocks one of first and second control signals Vcon1 and Vcon2, respectively to the gates of transistors T_H1 and T_L1, respectively.

One of the third and fourth transistors T_H1 and T_L1 in respective common control units VC_UNT2 and VC_UNT3 is activated by the first control signal Vcon1 or the second control signal Vcon2 transmitted through the first and second transistors Tc1 and Tc2. The activated one of the third and fourth transistors T_H1 and T_L1 applies a common high voltage VCOM_H or a common low voltage VCOM_L to the corresponding common voltage line VL2 or VL3.

The second gate line GL2 is electrically connected to the gate electrode of a transistor T21 provided at a pixel P21. The second common voltage line VL2 corresponding to the second gate line GL2 is connected to the drain electrode of the transistor T21 through a liquid crystal capacitor Clc and a storage capacitor Cst connected in parallel with each other.

The first transistor Tc1 and the second transistor Tc2 can be of the same type. For example, both the first transistor Tc1 and the second transistor Tc2 can be P-type transistors. Alternatively, both the first transistor Tc1 and the second transistor Tc2 can be N-type. When the transistors Tc1 and Tc2 are of the same type, they can be driven simultaneously by the scan signals Vgate1 and Vgate2 provided through the gate lines GL1 and GL2 of the previous stage, and the first control signal Vcon1 and second control signal Vcon2 can be transferred to the third and fourth transistors T_H1 and T_L1. Moreover, because the first control signal Vcon1 and the second control signal Vcon2 have different voltage levels, one of the transistors T_H1 and T_L1 is turned on to selectively apply either the common high voltage VCOM_H or the common low voltage VCOM_L to the common voltage lines VL2 and VL3.

In an embodiment of the present invention, the scan signal Vgate1 transmitted via the first gate line GL1 is commonly applied to the first and second transistors Tc1 and Tc2 of the second common voltage unit VC_UNT2. When the scan signal Vgate1 is applied to the second common voltage unit VC_UNT2, the second control signal Vcon2 is applied to the gate electrode of the third transistor T_H1 in VC_UNT2 through the first transistor Tc1 in VC_UNT2. The first control signal Vcon1 is applied to the gate electrode of the fourth transistor T_L1 in VC_UNT2 through the second transistor Tc2 in VC_UNT2. The first control signal Vcon1 and the second control signal Vcon2 provide opposite voltage levels. Thus, the fourth transistor T_L1 in VC_UNT2 is driven by the first control signal Vcon1, and the third transistor T_H1 in VC_UNT2 is driven by the second control signal Vcon2.

Thus, if the first control signal Vcon1 provides a low voltage and the second control signal Vcon2 has a high voltage, the third transistor T_H1, for example a P-type transistor, in VC_UNT2 is turned on, and the fourth transistor T_L1 in VC_UNT2 is turned off. The turned on transistor T_H1 in VC_UNT2 receives and transfers a common high voltage VCOM_H, while the turned-off fourth transistor T_L1 in VC_UNT2 blocks a common low voltage VCOM_L. Thereby, the common high voltage VCOM_H is applied to the common voltage line VL2 corresponding to the VC_UNT2.

In contrast, if the first control signal Vcon1 provides a high voltage and the second control signal has a low voltage, the third transistor T_H1 in VC_UNT2 is turned off, and the fourth transistor T_L1 in VC_UNT2 is turned on. The turned on transistor T_L1 in VC_UNT2 receives and transfers a common low voltage VCOM_L, while the turned-off transistor T_H1 in VC_UNT2 blocks a common high voltage VCOM_H. Thereby, the common low voltage VCOM_L is applied to the common voltage line VL2 corresponding to the VC_UNT2.

Meanwhile, the voltage level of the second control signal Vcon2 is stored in a first capacitor C1 connected between the third transistor T_H1 in VC_UNT2 and a ground, and the voltage level of the first control signal Vcon1 is charged in a second capacitor C2 connected between the fourth transistor T_L1 and the ground. The stored levels of the first and second control signals Vcon1 and Vcon2 maintain the corresponding one of the third and fourth transistors T_H1 and T_L1 in the turned-on state during one frame period.

The third common voltage unit VC_UNT3 is driven in a similar manner. In an embodiment of the present invention, the second control signal Vcon2 is applied to the gate electrode of the fourth transistor T_L1 in VC_UNT3 through the second transistor Tc2 in VC_UNT3. The first control signal Vcon1 is applied to the gate electrode of the third transistor T_H1 in VC_UNT3 through the first transistor Tc1 in VC_UNT3. As discussed above, the first control signal Vcon1 and the second control signal Vcon2 are provided with opposite voltage levels. Thus, the third transistor T_H1 in VC_UNT3 is driven by the first control signal Vcon1; and the fourth transistor T_L1 in VC_UNT3 is driven by the second control signal Vcon2.

In an embodiment, the second scan signal Vgate2 is applied to the third common voltage unit VC_UNT3 via the second gate line GL2. The first and second transistors Tc1 and Tc2 of the third common voltage unit VC_UNT3 are turned on by the second scan signal Vgate2 to transfer a common high voltage VCOM_H or a common low voltage VCOM_L. However, in contrast with the arrangement described above with regard to the second common voltage unit VC_UNT2, the first control signal Vcon1 is applied to the third transistor T_H1 of the third common voltage unit VC_UNT3, and the second control signal Vcon2 is applied to the fourth transistor T_L1.

Thus, the first control signal Vcon1 and the second control signal Vcon2 are applied to the third transistor T_H1 and fourth transistor T_L1 of adjacent common voltage units VC_UNT2 and VC_UNT3 in a reverse order. Accordingly, adjacent common voltage units VC_UNT2 and VC_UNT3 output a different common voltage at the same point of time.

In an embodiment of the present invention, the N-th gate line may not connected to the N-th common voltage unit but electrically connected to the (N+1)-th common voltage unit. Thus, the (N+1)-th common voltage unit may be driven by the scan signal applied to the N-th gate line to apply a common voltage to the (N+1)-th row of pixels. Thus, a common voltage can be applied to the (N+1)-th row of pixels one horizontal period prior to application of the corresponding scan signal to the (N+1)-th row of pixels.

Figure 6B:
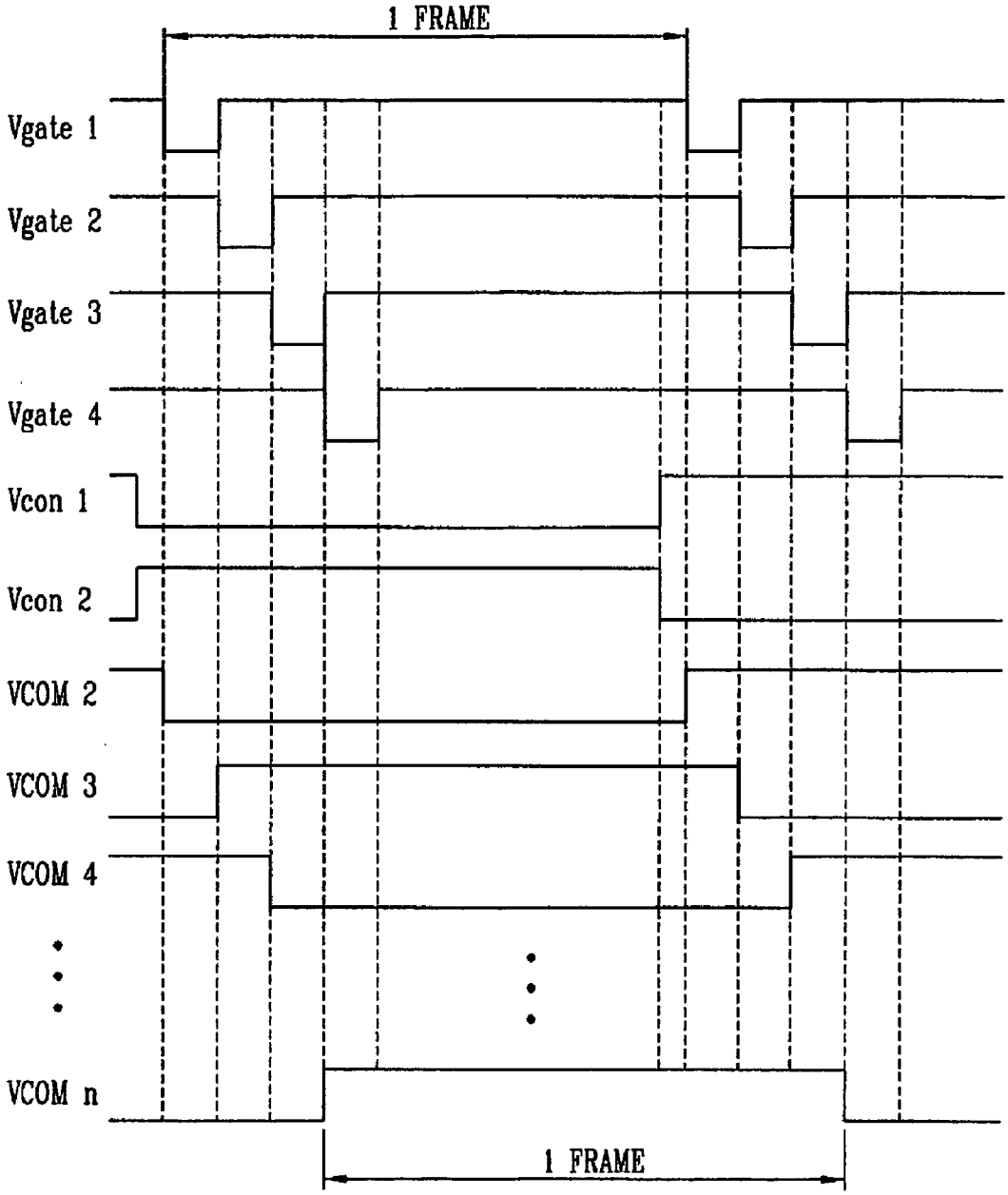
FIG. 6B shows an exemplary timing diagram of driving waveforms corresponding to the common voltage units of FIG. 6A.

FIG. 6B shows an exemplary timing diagram of driving waveforms corresponding to the common voltage units of FIG. 6A. Referring to FIG. 6A, the first control signal Vcon1 and the second control signal Vcon2 are outputted in opposite potential states during each frame period. Moreover, the respective potential states of the first control signal Vcon1 and the second control signal Vcon2 are reversed after each frame period.

When the first scan signal Vgate1 is applied to the second common voltage unit VC_UNT2, the common output voltage of the VC_UNT2 can be a low voltage. When the second scan signal Vgate2 is applied to the third common voltage unit VC_UNT3, the common output voltage VCOM3 of the VC_UNT3 can be a high voltage. Similarly, when the third scan signal Vgate3 is applied to a fourth common voltage unit, the common voltage VCOM4 is outputted as a low voltage. Thus, the first control signal Vcon1 and the second control signal Vcon2 are applied to the adjacent common voltage units VC_UNT2 and VC_UNT3 in reverse order, thereby driving the third transistor T_H1 and the fourth transistor T_L1 in a reverse order. Accordingly, the liquid crystal display device is being driven in the line inversion method because common voltages of different potentials are applied to adjacent rows of pixel.

As described above, each of the common voltage units VC_UNT2 and VC_UNT3 sequentially outputs common voltages VCOM2 and VCOM3 of different potentials, respectively, to the corresponding common voltage lines VL2 and VL3, which are electrically connected to the common electrodes of the pixels. Subsequent common voltage units VC_UNT3 and VC_UNT4 (not shown) can produce similarly alternating output patterns, such as VCOM4 and VCOM5, respectively. Concurrently, the data driving unit 120 (shown in FIG. 5) outputs a pixel image voltage to the pixel electrodes of the corresponding pixels P11. The outputted pixel image voltage at each pixel P11 has a level opposite the level of the corresponding one of the common voltages VCOM2 to VCOM5. Therefore, the voltage difference between the common electrode and the pixel electrode within each pixel P11 is increased.

In an embodiment of the present invention, by applying respective common voltages VCOM2 to VCOM5 to the corresponding common voltage lines VL2 to VL5, delays and distortions of the common voltages VCOM2 to VCOM5 that could have been caused by the load of the common electrode of each pixel P11 can be significantly reduced compared to the related art LCD device. Moreover, while each the pixels P11 in a current row corresponding to a gate line GL1 are being driven with a scan signal and provided with an image voltage, a common voltage VCOM2 is pre-applied to the next row of pixels on the common voltage line VL2, thereby raising in advance to a desired level the common voltage in the next driving stage. Similarly, while each the pixels P11 in a current row corresponding to a gate line GLn-1 are being driven with a scan signal and provided with an image voltage, a common voltage VCOMn is pre-applied to the next row of pixels on the voltage common line VLn, thereby raising in advance to a desired level the common voltage in the next driving stage. Thus, a desired level can be provided for the voltage difference between each of the common voltages VCOM2 to VCOM5 and the corresponding image voltage at each pixel, thereby improving the quality of the displayed image.

Figure 7A:
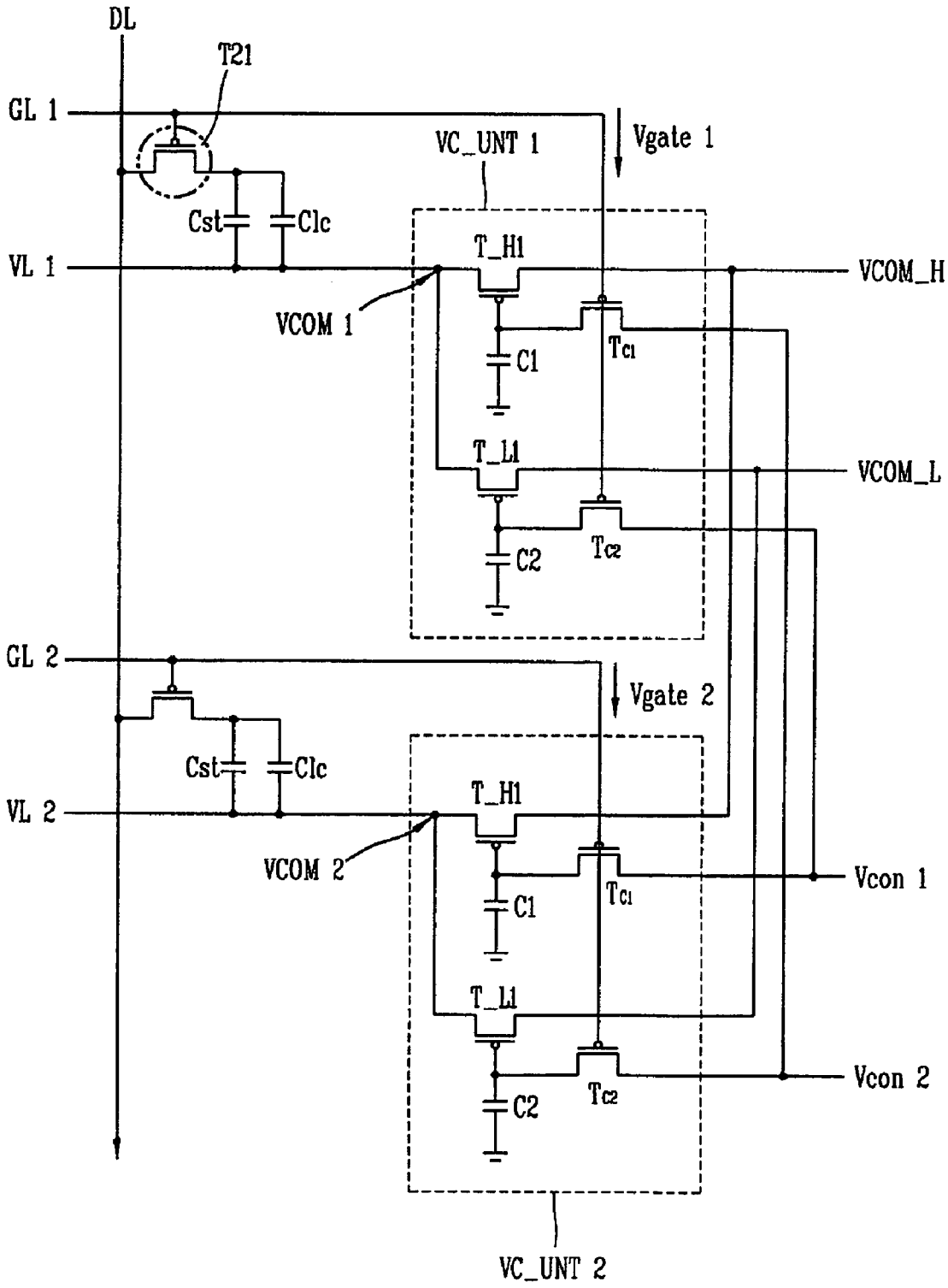
FIG. 7A is a detailed schematic view of exemplary common voltage units according to another embodiment of the present invention.

FIG. 7A is a detailed schematic view of exemplary common voltage units according to another embodiment of the present invention. The arrangement depicted in FIG. 7A is similar in parts to that described in FIG. 6A. Thus, a description of similar portions of the corresponding figures will be omitted.

Referring to FIG. 7A, the common voltage units VC_UNT1 and VC_UNT2 are driven by being applied with scan signals Vgate1 and Vgate2 from the gate lines GL1 and GL2 of the same stage, respectively. In an embodiment, the scan signal sequentially outputted from the gate driving unit 130 is supplied to one of the gate lines GL1 to GLn corresponding to a current driving stage, and simultaneously supplied to one of the common voltage units VC_UNT1 to VC_UNTn corresponding to the gate lines GL1 to GLn of the current driving stage. For instance, a scan signal Vgate1 outputted via the first gate line GL1 is supplied to the first common voltage unit VC_UNT1 corresponding to the first gate line GL1. Similarly, a scan signal Vgate2 outputted to the second gate line GL2 is also supplied to the second common voltage unit VC_UNT2.

Moreover, in accordance with another embodiment of the invention, each of the common voltage units VC_UNT1 and VC_UNT2 is driven concurrently with the corresponding row of pixels. For instance, the common voltage unit VC_UNT1 is provided with a scan signal Vgate1 during the same horizontal period as the corresponding current row of pixels P11 on gate line GL1. Similarly, the next common voltage unit VC_UNT2 subsequently is provided with a scan signal Vgate2 during the following horizontal period, concurrently with the next row of pixels P11 on the following gate line GL2. As described above, each of the common voltage units VC_UNT1 and VC_UNT2 applies a corresponding common voltage VCOM1 or VCOM2 to a respective one of the common voltage lines VL1 and VL2. Thus, the applied common voltage is provided to the corresponding pixels P11 without incurring a signal delay. Consequently, the pixels P11 can be sufficiently be charged by concurrently raising the common voltage to the desired level VCOM_H or VCOM_L, and applying scan signals GL1 to GLn to the pixels P11.

Figure 7B:
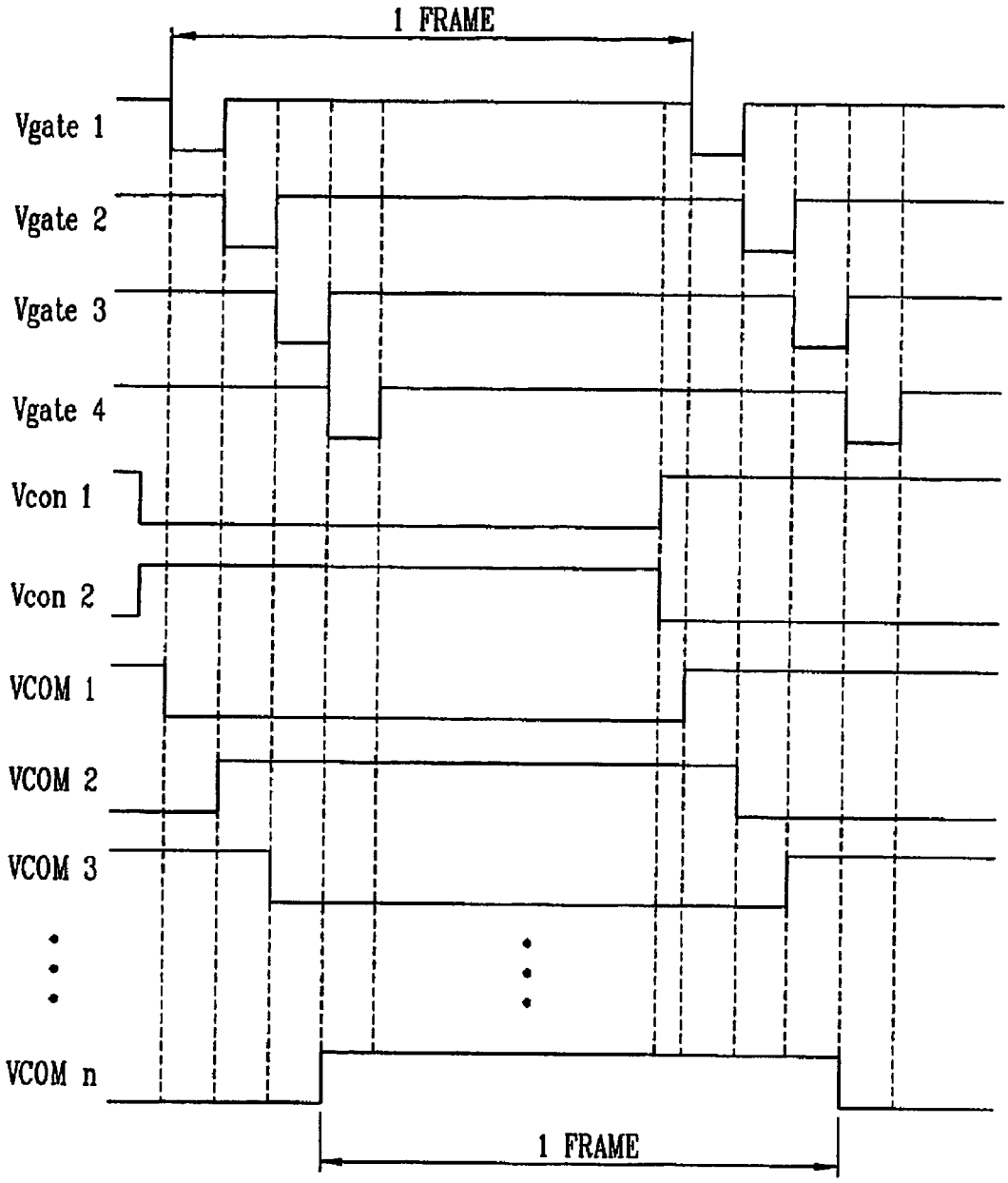
FIG. 7B shows an exemplary timing diagram of driving waveforms corresponding to the common voltage units of FIG. 7A.

FIG. 7B shows an exemplary timing diagram of driving waveforms corresponding to the common voltage units of FIG. 7A. The timing diagram of FIG. 7B is similar to the timing diagram of FIG. 6B. Thus, a description of the waveforms depicted in FIG. 7B will be omitted. Referring to FIGS. 7A and 7B, as discussed above, the scan signal Vgate1 is provided to the common voltage unit VC_UNT1 P11 on gate line GL1 during the same horizontal period when the corresponding first row of pixels is activated by the gate line GL1. Then, the a scan signal Vgate2 subsequently is provided to the next common voltage unit VC_UNT2 during the following horizontal period, concurrently with the next row of pixels P11 being activated by the following gate line GL2.

Thus, in accordance with an embodiment of the present invention, the liquid crystal display device includes a plurality of pixels arranged on a substrate; a first electrode and a second electrode provided on each of the pixels and forming a horizontal electric field; a plurality of data lines arranged on the substrate in a vertical direction, each data line electrically connected to a column of pixels; a plurality of gate lines and common voltage lines arranged on the substrate in a transverse direction, each gate line and each common voltage line electrically connected to a row of pixels; a data driving unit applying an image voltage to the first electrode of each of the pixels via the data lines; a gate driving unit sequentially supplying a scan signal to the rows of pixels via the gate lines; a plurality of common voltage units provided at one side of the common voltage lines and selectively applying a first common voltage or a second common voltage to the second electrode of each of a row of pixels via a corresponding one of the common voltage lines in accordance with a first and second control signals inputted in synchronization with the scan signal; and a gate driving unit supplying the scan signal to a N+1-th common voltage unit along with the n-th row of pixels via the N-th gate line.

In accordance with an embodiment of the present invention, common voltage units are provided on respective common voltage lines. Thus, each of the common voltage units drives only a corresponding one of the common voltage lines. Thereby, the load powered by the common voltage is reduced.

In accordance with an embodiment of the present invention, a first and a second control signals are applied to the adjacent common voltage units in a reverse order. Thus, adjacent common voltage units output opposite common voltage levels during each frame period, thereby common voltages of different potentials are applied to adjacent rows of pixel. Accordingly, the liquid crystal display device is being driven in the line inversion method. In accordance with an embodiment of the present invention, each of the common voltage units applies a corresponding common voltage to a respective one of the common voltage lines. Thus, the applied common voltage is provided to the corresponding pixels without incurring a signal delay. Accordingly, the pixels can be sufficiently be charged by concurrently raising the common voltage to a desired level and applying scan signals, thereby improving the quality of a displayed image.

It will be apparent to those skilled in the art that various modifications and variations can be made in the liquid crystal display device of the present invention without departing from the spirit or scope of the invention. Thus, it is intended that the present invention cover the modifications and variations of this invention provided they come within the scope of the appended claims and their equivalents.

What is claimed is:

1. A liquid crystal display device, comprising:

one or more data line on a substrate;

first to third gate lines crossing the one or more data line to form first to third pixels, the one or more data line providing an image signal to a first electrode of each of the first to third pixels, and the first to third gate lines providing first to third scan signals to the first to third pixels, respectively;

a first common voltage unit corresponding to the second gate line, the first common voltage unit for selectively applying a first common voltage to a second electrode of the second pixel via a first common voltage line in accordance with the first scan signal from the first gate line; and a second common voltage unit corresponding to the third gate line, the second common voltage unit for selectively applying a second common voltage to a second electrode of the third pixel via a second common voltage line in accordance with the second scan signal from the second gate line, wherein the first gate line and the second gate line are respectively connected to the first and second common voltage units to supply the scan signal of the first gate line and the second gate line so as to drive the first and second common voltage units, thereby the first and second common voltage units output respectively the common voltages are respectively supplied to the first and second common voltage units preceding to image voltages supplied to the data lines, wherein the second common voltage unit includes:

first and second transistors driven by the second scan signal from the second gate line, the first and second transistors for transferring or blocking first and second control signals; and third and fourth transistors whose gate electrodes are connected to drain electrodes of the first and second transistors, respectively, one of the third and fourth transistors selectively turned on by one of the first and second control signals selectively transferred by one of the first and second transistors, and applying one of the first and second common voltages to the second common voltage line.

2. The liquid crystal display device of claim 1, wherein the first control signal and the second control signal are applied to the first transistor and second transistor in a reverse order.

3. The liquid crystal display device of claim 1, wherein the first and second transistors are of the same type.

4. The liquid crystal display device of claim 1, wherein the third and fourth transistors are of the same type.

5. The liquid crystal display device of claim 1, wherein the first and second control signals have potentials different from each other at each frame period.

6. The liquid crystal display device of claim 1, wherein each of the first and second control signals has a potential changing at each frame period.

7. The liquid crystal display device of claim 1, wherein the first common voltage is different from the second common voltage.

8. The liquid crystal display device of claim 1, wherein the second common voltage unit is additionally provided with first and second capacitors respectively connected to gate electrodes of the third and fourth transistors for storing the first and second control signals and respectively providing the first and second control signals to the third and fourth transistors during one frame period.

9. The liquid crystal display device of claim 1, wherein the image signal provided to the first pixel has a different potential from the selectively applied one of the first and second common voltages.

10. A method of driving a liquid crystal display device, providing an image signal to a first electrode of each of first and second pixels through one or more data line;

providing first and second scan signals to the first and second pixels respectively through first and second gate lines;

providing the first scan signal to a first common voltage unit corresponding to the first gate line to drive the first common voltage unit;

selectively applying a first common voltage outputted by the first common voltage unit to a second electrode of the first pixel via a first common voltage line;

providing the second scan signal to a second common voltage unit corresponding to the second gate line to drive the second common voltage unit, wherein the second common voltage unit includes:

first and second transistors driven by the second scan signal from the second gate line, the first and second transistors for transferring or blocking first and second control signals; and third and fourth transistors whose gate electrodes are connected to drain electrodes of the first and second transistors, respectively, one of the third and fourth transistors selectively turned on by one of the first and second control signals selectively transferred by one of the first and second transistors, and applying one of the first and second common voltages to the second common voltage line; and selectively applying a second common voltage outputted by the second common voltage unit to a second electrode of the second pixel via a second common voltage line.

* * * * *